US009288565B2

(12) United States Patent
Cardas

(10) Patent No.: US 9,288,565 B2
(45) Date of Patent: Mar. 15, 2016

(54) EARPHONE SYSTEM

(75) Inventor: George Cardas, Bandon, OR (US)

(73) Assignee: CARDAS AUDIO LTD., Bandon, OR (US)

( * ) Notice: Subject to any disclaimer, the term of this patent is extended or adjusted under 35 U.S.C. 154(b) by 848 days.

(21) Appl. No.: 13/333,816

(22) Filed: Dec. 21, 2011

(65) Prior Publication Data

US 2012/0163648 A1 Jun. 28, 2012

Related U.S. Application Data

(60) Provisional application No. 61/427,039, filed on Dec. 23, 2010.

(51) Int. Cl.

| | |
|---|---|
| ***H04R 25/00*** | (2006.01) |
| ***H04R 1/10*** | (2006.01) |
| ***H04R 1/28*** | (2006.01) |
| ***H04R 1/30*** | (2006.01) |

(52) U.S. Cl.
CPC ..... *H04R 1/1016* (2013.01); *H04R 1/2811* (2013.01); *H04R 1/30* (2013.01)

(58) Field of Classification Search
CPC ..... H04R 1/1075; H04R 1/1041; H04M 1/05
USPC ..... 381/374, 380, 375, 328
See application file for complete search history.

(56) References Cited

U.S. PATENT DOCUMENTS

| | | | | |
|---|---|---|---|---|
| 2,325,590 | A * | 7/1943 | Carlisle et al. | 381/328 |
| 3,819,860 | A * | 6/1974 | Miller | H04B 1/40 381/332 |
| 4,069,400 | A * | 1/1978 | Johanson et al. | 381/324 |
| 5,195,139 | A * | 3/1993 | Gauthier | 381/322 |
| 5,631,965 | A * | 5/1997 | Chang et al. | 381/72 |
| 6,622,815 | B2 * | 9/2003 | Kolpe et al. | 181/130 |
| 8,180,093 | B2 * | 5/2012 | Hankey et al. | 381/374 |
| 8,625,831 | B2 * | 1/2014 | Rung | H04R 25/48 381/328 |
| 8,983,103 | B2 * | 3/2015 | Vlach | H04R 25/554 381/328 |
| 2006/0045297 | A1 * | 3/2006 | Haussmann | A61F 11/08 381/322 |
| 2006/0147034 | A1 * | 7/2006 | Chou | H04M 1/05 379/430 |
| 2008/0166005 | A1 * | 7/2008 | Terlizzi et al. | 381/375 |
| 2008/0166007 | A1 * | 7/2008 | Hankey et al. | 381/380 |

(Continued)

FOREIGN PATENT DOCUMENTS

WO WO2010066299 * 6/2010

OTHER PUBLICATIONS

URL: http://www.theabsolutesound.com/articles/ear-speakers-from-cardas-audio-now-available/ Article Title: Ear Speakers from Cardas Audio Now Available. Website Title: The Absolute Sound Author: TAS staff. Date: Jun. 25, 2013.*

(Continued)

*Primary Examiner* — Davetta W Goins
*Assistant Examiner* — Phylesha Dabney
(74) *Attorney, Agent, or Firm* — Rylander & Assoc., PC; Philip R. M. Hunt

(57) ABSTRACT

An earphone system comprising an ear canal portion with an interior surface having a logarithmic spiral taper shape, a base portion, and a speaker, wherein the ear canal portion and the base portion detachably engage to hold the speaker between and within the ear canal portion and the base portion. In some embodiments, the logarithmic spiral taper shape may further be a golden spiral taper shape, a Fibonacci spiral taper shape, or a cochleal taper shape.

5 Claims, 3 Drawing Sheets

(56) References Cited

U.S. PATENT DOCUMENTS

| | | | | |
|---|---|---|---|---|
| 2008/0240486 | A1* | 10/2008 | Garcia et al. | 381/380 |
| 2008/0279409 | A1* | 11/2008 | Hupkes | 381/370 |
| 2010/0088883 | A1* | 4/2010 | Kwon | 29/594 |
| 2013/0230201 | A1* | 9/2013 | Rizzello | H04R 1/26 381/332 |

OTHER PUBLICATIONS

URL: http://www.theabsolutesound.com/articles/cardas-audio-em5813-ear-speaker/ Article Title: Cardas Audio EM5813 Ear Speaker Website Title: The Absolute Sound Author: Chris Martens Date: Dec. 9, 2013.*

* cited by examiner

EARPHONE SYSTEM

CROSS-REFERENCE TO RELATED APPLICATION

This application is a nonprovisional that claims priority to provisional Application Ser. No. 61/427,039, filed 23 Dec. 2010 which is hereby incorporated herein by reference.

FIELD OF THE INVENTION

The present invention relates to an audio earphone system. More particularly, the present invention relates to an audio ear bud speaker system with improved audio reproduction characteristics.

BACKGROUND

Headphones are generally a pair of small loudspeakers, or less commonly a single speaker, with a way of holding them close to a user's ears and a means of connecting them to an audio signal source. Headphones may also be known as stereophones or headsets. In particular, the in-ear versions of headphones may be known as earphones or earbuds. Headphones can be used both with fixed equipment (e.g., audio amplifier, radio, CD or DVD player, personal computer, and/or any other fixed audio signal source) and with portable/mobile audio devices (e.g., digital audio player, MP3 player, mobile telephone, mobile smartphone, or any other portable/mobile audio signal source).

Headphones may couple to one or more audio signal sources with a wired connection, a wireless connection, and/or a combination thereof. Wired headphones are generally attached to an audio signal source with 6.35 mm (¼") and 3.5 mm TRS connectors and sockets. The larger 6.35 mm connector tends to be found on fixed location home or professional audio equipment while the 3.5 mm "minijack" connector may be common on portable/mobile audio devices. Alternately, wireless (e.g., cordless) headphones are not connected to the audio signal source via a wire and may alternately receive the audio encoded in a radio or infrared transmission link. Common wireless transmission links may correspond to Bluetooth or Wi-Fi (I.E.E.E. 802.1n) standards, in particular for mobile audio devices, mobile phones, and/or mobile smartphones.

As introduced, in-ear versions of the headphones (e.g., earphones and earbuds) are headphones of a much smaller size that are placed directly outside, adjacent, or at least partially within the ear canal. Earphones or earbuds that are placed outside the ear canal may generally be inexpensive and may be favored for their portability and convenience. However, they may provide little or any isolation from the noise of the user's environment and/or surroundings. Accordingly, the outside earphones or earbuds are often used at higher volumes in order to drown out the environmental noise, potentially contributing to hearing damage or permanent hearing loss.

Higher quality earphones or earbuds may extend at least partially within the ear canal. The location at least partly within the ear canal may improve the isolation of the earphones or earbuds from environmental and/or surrounding noise. Earphones or earbuds configured as such may include one or more additional isolating elements, components, and/or portions to increase the isolation. For example, the earphones or earbuds may include a sleeve, one or more baffles, or the like to more snugly fit at least partly within the ear canals to improve isolation. The sleeves, baffles, and the like may be commonly formed from silicone rubber, elastomer, and/or foam that may conform to the ear canal into which the sleeve or baffle is at least party inserted, for noise isolation.

A number of devices have provided earphones or earbuds with various designs and/or features. The following represents a list of known related art:

| Reference: | Issued to: | Date of Issue/Publication: |
|---|---|---|
| US 2009/0290739 | Edwards et al. | Nov. 26, 2009 |
| U.S. Pat. No. 7,757,400 | Widmer et al. | Jul. 20, 2010 |
| U.S. Pat. No. 7,676,051 | Fischer et al. | Mar. 9, 2010 |
| U.S. Pat. No. 6,860,362 | Saltykov | Mar. 1, 2005 |
| U.S. Pat. No. 5,420,930 | Shugart, III | May 30, 1995 |
| U.S. Pat. No. 5,344,387 | Lupin | Sep. 6, 1994 |
| U.S. Pat. No. 4,357,497 | Hochmair et al. | Nov. 2, 1982 |
| U.S. Pat. No. 2,804,072 | Genzer | Aug. 27, 1957 |
| U.S. Pat. No. 2,573,923 | Mezz | Nov. 6, 1951 |
| U.S. Pat. No. 1,564,474 | Fensky | Dec. 8, 1925 |
| US D492,765 | Falco | Jul. 6, 2004 |
| US D464,039 | Boesen | Oct. 8, 2002 |
| US D371,193 | Myers et al. | Jun. 25, 1996 |
| US D141,071 | Hechler | May 1, 1945 |
| JP 57-015,600 | Obara et al. | Jan. 26, 1982 |

The teachings of each of the above-listed citations are herein incorporated by reference. None of the above inventions and patents, taken either singularly or in combination, is seen to describe the instant invention as claimed.

SUMMARY AND ADVANTAGES

One embodiment described herein is an earphone system comprising an ear canal portion having an interior surface with a logarithmic spiral taper shape, a base portion, and a speaker, wherein the ear canal portion and the base portion detachably engage to hold the speaker between and within the ear canal portion and the base portion. In various embodiments of the invention, the logarithmic spiral taper shape of the ear canal portion interior surface may further be a golden spiral taper shape, a Fibonacci spiral taper shape, or a cochleal taper shape.

The earphone system of the present invention presents numerous advantages, including: (1) increased speaker/driver efficiency; (2) increased audio output clarity; (3) increased audio output imaging; (4) decreased audio output distortion.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show exemplary embodiments of the present invention.

BRIEF DESCRIPTION OF THE DRAWINGS

The present invention will be described by way of exemplary embodiments, illustrated in the accompanying drawings in which.

REFERENCE NUMBERS USED IN DRAWINGS

Figure 1:
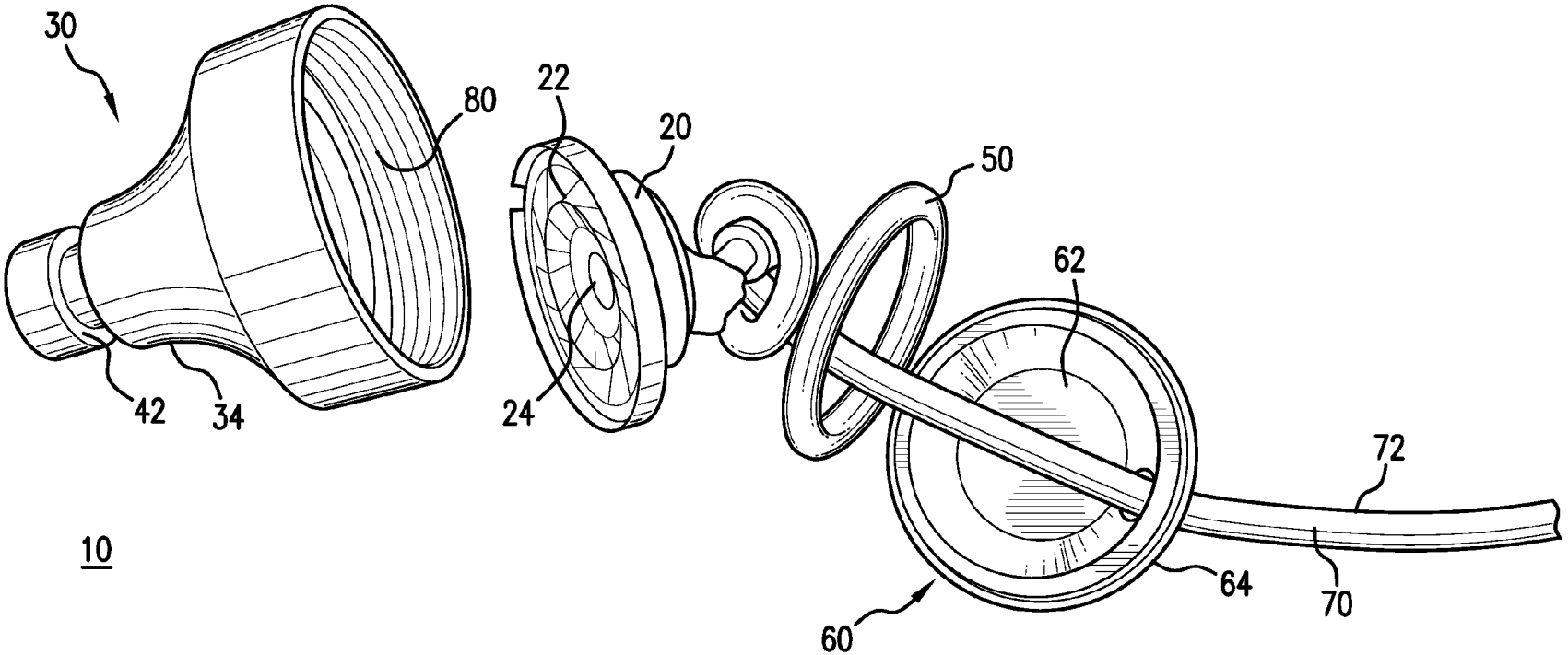
FIG. 1 shows an embodiment of an earphone system.

In the drawings, similar reference characters denote similar elements throughout the several views. With regard to the reference numerals used, the following numbering is used throughout the various drawing figures:

10 earphone system
20 speaker/driver
22 diaphragm
24 voice coil
30 ear canal portion
32 ear canal portion interior surface
34 ear canal portion exterior surface
36 ear canal portion cavity
38 ear canal portion aperture
39 ear canal portion shoulder
42 isolation member detent
50 speaker/driver retaining member
60 base portion
62 base portion interior surface
64 base portion exterior surface
66 base portion cavity
68 base portion aperture
70 interconnect wire
72 interconnect wire exterior surface
74 interconnect wire connector
80 ear canal portion detachable connector
82 base portion detachable connector
90 logarithmic spiral

DETAILED DESCRIPTION

In the following detailed description, reference is made to the accompanying drawings in which are shown exemplary embodiments of the invention. Embodiments other than those shown in the drawings or otherwise described in this specification may be possible, omitting some of the features described, or adding addition features, without departing from the essence of the invention. The appearances of the phrase "in one embodiment" in various places in the specification do not necessarily all refer to the same embodiment, nor to any specific embodiment. Reference in the specification to a particular feature described in connection with phrases such as "in one embodiment" merely means that feature is included in at least one embodiment of the invention, but not necessarily all embodiments. Therefore, the following detailed description is not to be taken in a limiting sense, and the scope of the present invention is defined by the appended claims and their equivalents.

The figure drawings associated with this disclosure typically are not drawn with dimensional accuracy to scale, i.e., such drawings have been drafted with a focus on clarity of viewing and understanding rather than dimensional accuracy.

As used in this application, the term and/or means the elements linked by this term may be joined disjunctively or conjunctively. For example, the phrase "A and/or B" means (A), (B), or (A and B). The phrase "A, B, and/or C" means (A), (B), (C), (A and B), (A and C), (B and C) or (A, B and C). This application may use perspective-based language such as up/down, back/front, and top/bottom. Such language is merely used to facilitate the discussion, showing the relative relationship of components and is not intended to restrict embodiments of the present invention to any absolute frame of reference.

Figure 2:
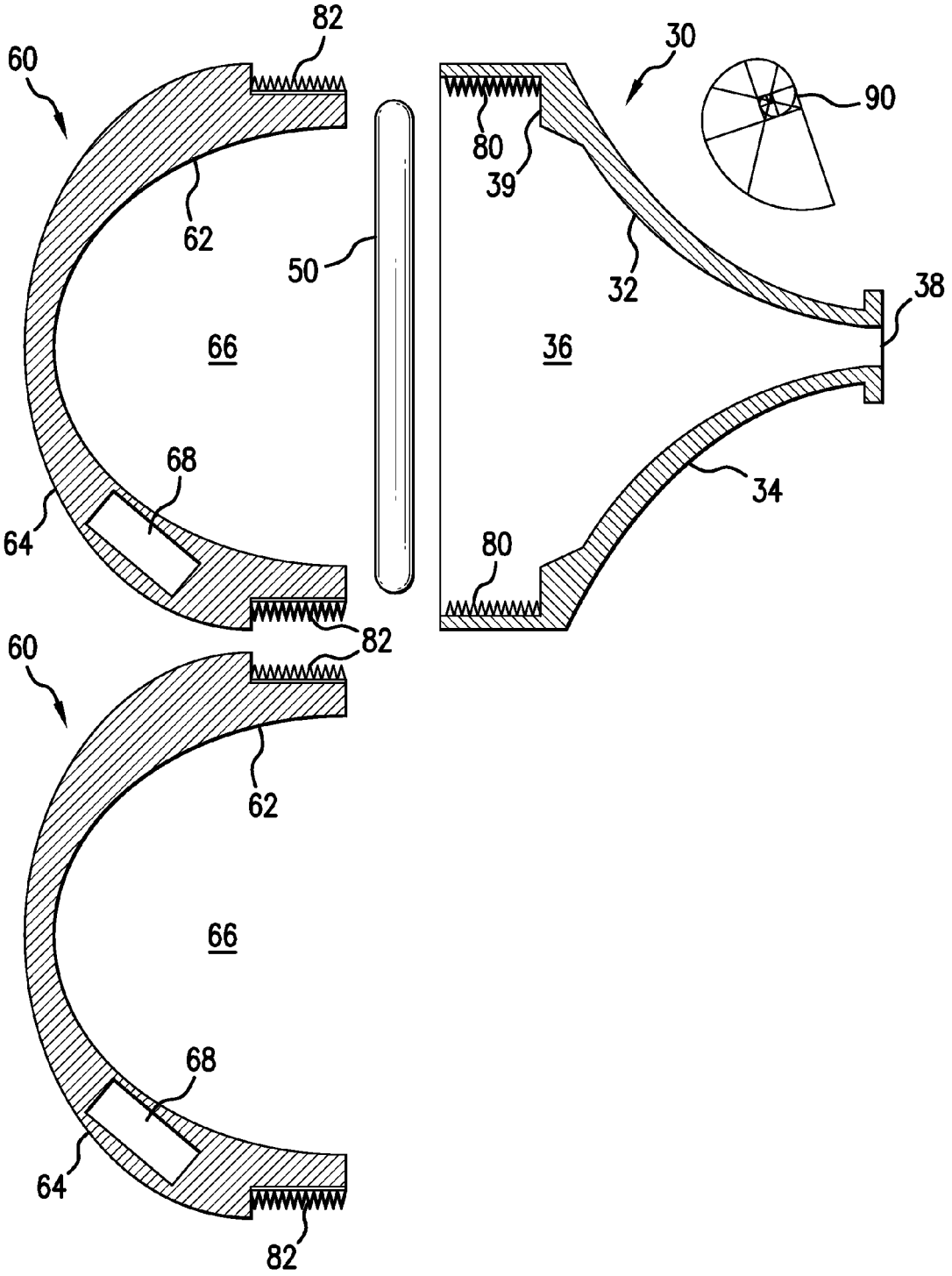
FIG. 2 shows cross sections of the ear canal portion and the base portion of the earphone system.
Figure 3:
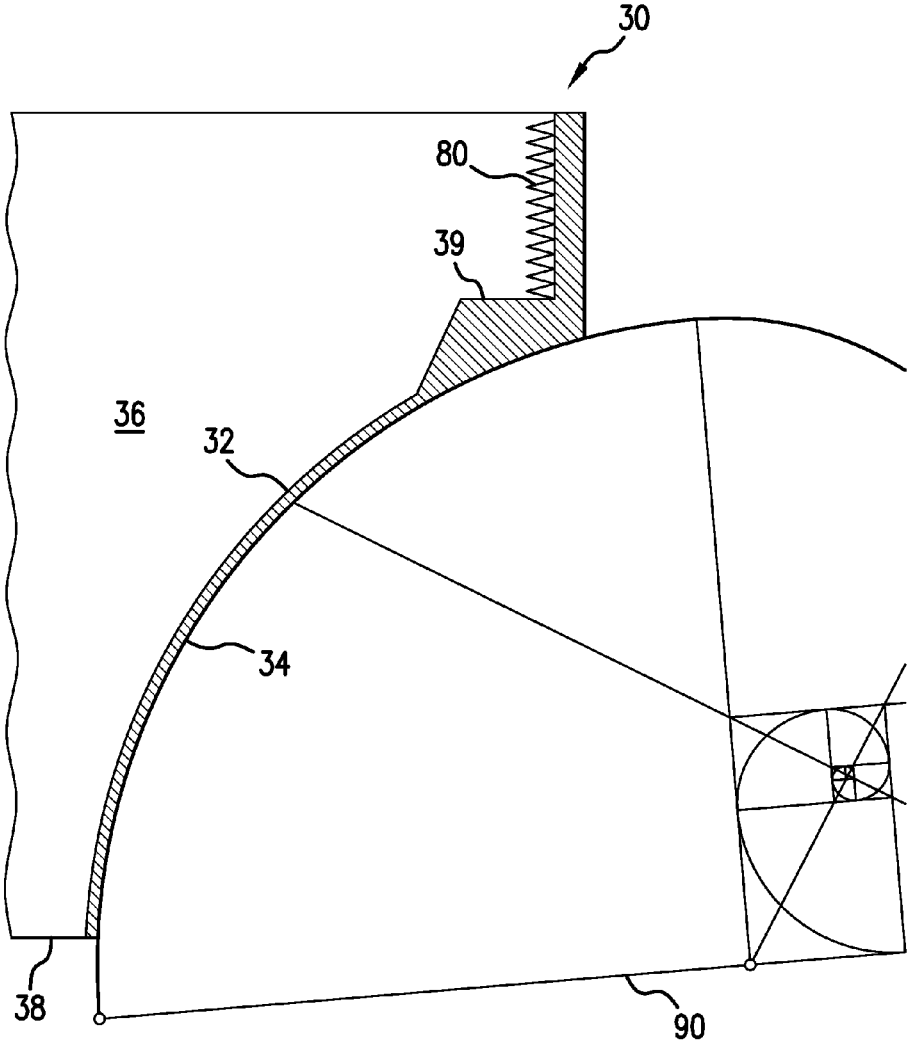
FIG. 3 shows a cross section of the ear canal portion of the earphone.

FIGS. 1-3, show one embodiment of an earphone system 10. Earphone system 10 generally comprises a speaker/driver 20 enclosed in an ear canal portion 30 and a base portion 60 and held in place by speaker/driver retaining member 50. The speaker/driver 20 couples to an interconnect wire 70 that in turn couples to an audio signal source (not illustrated). The ear canal portion 30 has an isolation member (not shown) coupled thereto. The isolation member is configured to at least partially isolate the ear canal portion 30 from environmental and/or external noises and sounds. The shape and configuration of the ear canal portion 30, the base portion 60, and/or a combination thereof improves the quality of the audio output from the speaker/driver 20 over previous known designs. More specifically, the shape and configuration of the ear canal portion 30, the base portion 60, and/or a combination thereof, decreases acoustic distortion and improves the clarity, stereo imaging and efficiency of the audio output from the speaker/driver 20.

The speaker/driver 20 generates an audio output in response to receiving an audio input signal from wire 70 coupled to an audio input signal source (not illustrated). The speaker/driver 20 may comprise any type of driver known in the art to produce an audio output in response to receiving an audio input signal. In at least one embodiment, the speaker/driver 20 comprises a moving coil driver including a diaphragm 22 driven by a voice coil 24. The actuation (i.e., vibration) of the diaphragm 22 by the voice coil 24 generates an oscillating pressure wave in the adjacent air that may be thereafter detected (i.e., heard) by the user's ear drum. In at least one embodiment, the speaker/driver 20 reproduces audio input signals approximately between 20 Hz and 20 kHz, corresponding to the capability of a typical user's ear and thus to the expected range of audio input signals. In at least one embodiment, the speaker/driver 20 is positioned within the ear canal portion 30, the base portion 60, or a combination thereof and held in place with a speaker/driver retaining member 50. For example, the speaker/driver 20 of some embodiments seats against the ear canal member shoulder 39. The speaker/driver retaining member 50 follows the speaker/driver 20 opposite the ear canal member shoulder 39. In at least one embodiment, the ear canal portion 30 and the base portion 60 are detachably joined, for example with the detachable engagement of ear canal portion detachable connector 80 and base portion detachable connector 82. In such embodiments, at least a portion of the base portion detachable connector 82 detachably engages the speaker/driver retaining member 50. Accordingly, the base portion detachable connector 82 may press the speaker/driver 20 between the speaker/driver retaining member 50 and the ear canal member shoulder 39 to position and hold the speaker/driver 20 in place.

In at least one embodiment, the size of the speaker/driver 20 is correlated to the size of the user's ear. More particularly, for the moving coil motor embodiment of speaker/driver 20, the surface area of the diaphragm 22 is approximately the surface area of the user's ear drum. Accordingly, when the speaker/driver 20 operates, the air displaced by the diaphragm 22 approximates the air displaced in the user's ear canal during normal hearing events (i.e., without the earphone system 10 placed in the user's ear canals). Said differently, the diaphragm 22 mimics the size and operation of the user's ear drum so that the audio output generated by the diaphragm 22 may be accurately detected by the user's ear drum. In at least one embodiment, the earphone system 10 includes multiple sizes and/or configurations of the speaker/driver 20 to correspond to a typical range of users' ear drum sizes. A user can select the speaker/driver 20 of the size that works best for that user and assemble the earphone system 10 accordingly.

In an alternative embodiment, instead of approximating the size of the user's ear drum, the diaphragm 22 of the speaker/driver 20 is proportional to the size of the user's ear drum.

In at least one embodiment, the sizes of users' ear drums are correlated into statistical groupings of ear drum sizes. Accordingly in these embodiments, the earphone system 10 includes diaphragms 22 of multiple sizes (e.g., small, medium, and large) to correlate to the statistical groupings of ear drum sizes. A user can select the diaphragm 22 of the size that works best for that user and assemble the earphone system 10 accordingly.

As noted, in at least one embodiment, at least a portion of the ear canal portion 30 may extend into the ear canal of a user. Generally speaking, the audio output of the speaker/driver 20 may project through an ear canal portion aperture 38 to the user's inner ear. To isolate the audio output from environmental or otherwise outside or external noise, sounds, and the like, the ear canal portion 30 may be coupled to an isolation member. The ear canal portion 30 may have an isolation member detent 42 configured to couple to the isolation member. The isolation member may be formed from silicone rubber or any other biologically compatible elastomeric material and may partially conform to the user's ear canal.

In at least one embodiment, the size and/or configuration of the ear canal portion 30 and/or the base portion 60 depends on the size of the speaker/driver 20 contained therein. Likewise, the size and/or configuration of the ear canal portion aperture 38 depends on the size and/or configuration of the ear canal portion 30 that in turn depends on the size of the speaker/driver 20 contained therein. Accordingly, as the size and/or configuration of the speaker/driver 20 may reflect the approximate size of the ear drum for which it is designed, so too the size and/or configuration of the ear canal portion 30 and the base portion 60 may depend at least in part on the size of the ear (including ear canal) for which the speaker system 10 is designed.

As previously stated, the configuration of the ear canal portion 30, the base portion 60, or a combination thereof may increase the efficiency and quality of the audio output (e.g., by decreasing acoustic distortion) of the earphone system 10 as compared to existing earphone or earbud systems. More specifically, in at least one embodiment, the shape of the ear canal portion cavity 36, the shape of the base portion cavity 66, or a combination thereof may contribute to the quality of the audio output of the earphone system 10 as experienced by a user wearing the earphone system 10. The specific configurations of the ear canal portion 30 and the base portion 60 will be discussed in turn. Though described individually, as the ear canal portion 30 may detachably engage the base portion 60 (i.e., the ear canal portion connector 80 may detachably engage the base portion connector 82), in at least one embodiment the combination of the ear canal portion 30 and the base portion 60 (i.e., the overall shape of the earphone system 10 including the overall shape of the cavity formed therein) including the location, size, and configuration of the speaker/driver 20 contributes to the quality of the audio output of the earphone system 10 as experienced by the user.

FIG. 2 more specifically illustrates the ear canal portion 30 of earphone system 10. The ear canal portion 30 includes an ear canal portion exterior surface 34 and an ear canal portion interior surface 32 that defines the ear canal portion cavity 36. In at least one embodiment, the ear canal exterior surface 34 may have the same shape as the ear canal portion interior surface 32. For example, the ear canal portion 30 may have a uniform thickness, in particular for the portion of the ear canal portion 30 that may extend into the ear canal of the user. In other embodiments, the ear canal exterior surface 34 may have a different shape form the ear canal portion interior surface 32. The audio output of the speaker/driver 20 is channeled or otherwise directed by the ear canal portion interior surface 32 to the ear canal portion aperture 38. Thereafter, the audio output may be detected by the user's inner ear.

As also illustrated by FIG. 2, the ear canal portion 30 has a curved taper shape from adjacent the ear canal portion detachable connector 80 to the ear canal portion aperture 38. In at least one embodiment, the curved taper shape of the ear canal portion 30 mimics the shape of the cochlea of a human ear. The cochlea is a spiraled, hollow, conical chamber of bone that functions to convert vibrations from the middle ear (representative of audio signal vibrations received through the ear canal) to electrical impulses that travel along the auditory nerve to structures in the brainstem for further processing. The spiral-shaped cavity of the cochlea resembles that of a nautilus or snail shell and may be approximated mathematically by a logarithmic spiral. The coiled form of the cochlea is unique to mammals and increases the frequency range of hearing and/or frequency resolution of the mammalian ear. The similar shape of the ear canal portion 30 to a human cochlea increases the quality of the audio output of the speaker/driver 20 as experienced by the user.

As specifically illustrated by FIGS. 2 and 3, the curved taper shape of the ear canal portion 30 correlates to and/or mimics the shape of the cochlea of the ear into which the ear canal portion 30 may be inserted. Accordingly, the curved taper shape of the ear canal portion 30 represents a portion of a logarithmic spiral, as illustrated by logarithmic spiral 90. Among other properties, the logarithmic spiral 90 and the corresponding curvature of the ear canal portion 30 (in particular the ear canal portion inner surface 32 and the resulting ear canal portion cavity 36) has the property that the angle between the tangent line and the radial line at a particular point along the curve is a constant. In at least one embodiment, the logarithmic spiral 90 may be a golden spiral, with the growth factor of the spiral related to the golden ratio. Alternately, the logarithmic spiral may a Fibonacci spiral. The golden spiral and the Fibonacci spiral may be used as mathematical approximations of the nautilus shell shape of the cochlea. Accordingly, for a particular size of ear canal portion 30 based on the size of the user (e.g., youth, adult, small, medium, large, or any other subjective indication of size), the curvature of the ear canal portion 30 (in particular the ear canal portion inner surface 32 and the resulting ear canal portion cavity 36) may be determined mathematically to correlate to and/or mimic the shape of the cochlea of the ear into which the ear canal portion 30 is to be inserted. Accordingly, the mathematically determined shape of the ear canal portion 30, based on its similarity to the human cochlea, increases the quality of the audio output of the speaker/driver 20 as experienced by the user.

Overall, unlike to the ear canal portion of prior art earphone systems, the earphone system 10 includes an ear canal portion 30 that mimics the user's cochlea. In particular, the ear canal portion 30 and the ear canal portion cavity 36 may function as an inverse horn for the speaker/driver 20. More specifically, by utilizing a logarithmic spiral curvature (in some embodiments, a golden spiral or a Fibonacci spiral) the ear canal portion 30 inverse horn shape avoids repeating tangents to more correctly match the acoustical impedance of the speaker/driver 20 to the user's ear canal by mirroring the hearing mechanisms of the ear. By doing so, the earphone system 10 functions with greater efficiency and lower acoustic distortion compared to prior art earphone system designs.

In addition to the shape and configuration of the ear canal portion 30, the shape and configuration of the base portion 60 may further contribute to the increased efficiency and decreased acoustic distortion of the earphone system 10. As illustrated by FIG. 2, the base portion 60 including base portion interior surface 62 that defines base portion cavity 66. In at least one embodiment, the base portion interior surface 62 and corresponding base portion cavity 66 have a parabolic shape. In an alternate embodiment, the base portion interior surface 62 and corresponding base portion cavity 66 have an elliptical shape. In at least one embodiment, the ratio of the height of the elliptical shape of the base portion cavity 66 (as illustrated by FIG. 2) to the width of the elliptical shape of the base portion cavity 66 is approximately 1.14.

As noted, the earphone system 10 has increased speaker/driver efficiency, increased audio output clarity, increased audio output imaging, and/or decreased audio output distortion compared to existing earphone system designs. The increased performance of the earphone system 10 is also due to the more efficient damping. More specifically, the overall shape and design of the earphone system 10 decreases the stacking and/or compression of sound waves as they emit from the diaphragm 22 of the speaker/driver 20 and travel to the user's ear drums, which would otherwise negatively affect the perceived quality of the generated sound.

Although specific embodiments have been illustrated and described herein, it will be appreciated by those of ordinary skill in the art and others, that a wide variety of alternate and/or equivalent implementations may be substituted for the specific embodiment shown and described without departing from the scope of the present invention. This application is intended to cover any adaptations or variations of the embodiment discussed herein. Therefore, it is manifested and intended that the invention be limited only by the claims and the equivalents thereof.

What is claimed is:

1. An earphone, comprising:

a speaker;

an ear canal portion having an interior surface with a cochleal taper shape; and a base portion configured to detachably engage to the ear canal portion to hold the speaker between and within the ear canal portion and the base portion.

2. An earphone, comprising:

a speaker;

an ear canal portion having an interior surface with a taper shape that mimics the shape of the cochlea; and a base portion configured to detachably engage to the ear canal portion to hold the speaker between and within the ear canal portion and the base portion.

3. A method for providing an earphone system, comprising:

providing a set of ear canal portions, each having an interior surface with a cochleal taper shape of a differently curvature;

providing a set of speaker diaphragms, each speaker diaphragm of a different size in surface area; and providing a base portion configured to detachably engage to hold a selected one of the speaker diaphragms between and within a selected one of the ear canal portions and the base portion.

4. The method of claim 3 further comprising making the size of each of the speaker diaphragms based on a surface area of an average eardrum in one of a set of statistical groupings of ear drum sizes.

5. The method of claim further comprising making the size and shape of each of the ear canal portions based on a size of an average ear in one of a set of statistical groupings of ear sizes.

* * * * *